US009459546B2

(12) United States Patent
Yoon et al.

(10) Patent No.: US 9,459,546 B2
(45) Date of Patent: Oct. 4, 2016

(54) TONER TO DEVELOP ELECTROSTATIC LATENT IMAGES

(71) Applicant: Samsung Electronics Co., Ltd, Suwon-si, Gyeonggi-do (KR)

(72) Inventors: Se-young Yoon, Hwaseong-si (KR); Sung-jin Park, Suwon-si (KR); Hong-chul Shin, Suwon-si (KR); Seung-sik Woo, Hwaseong-si (KR); In-su Lee, Suwon-si (KR)

(73) Assignee: SAMSUNG ELECTRONICS, CO., LTD., Suwon-Si (KR)

( * ) Notice: Subject to any disclaimer, the term of this patent is extended or adjusted under 35 U.S.C. 154(b) by 0 days.

(21) Appl. No.: 14/143,198

(22) Filed: Dec. 30, 2013

(65) Prior Publication Data

US 2015/0118611 A1 Apr. 30, 2015

(30) Foreign Application Priority Data

Oct. 29, 2013 (KR) ..... 10-2013-0129567

(51) Int. Cl.
*G03G 9/087* (2006.01)
*G03G 9/08* (2006.01)
*G03G 9/097* (2006.01)

(52) U.S. Cl.
CPC ..... *G03G 9/08755* (2013.01); *G03G 9/081* (2013.01); *G03G 9/0821* (2013.01); *G03G 9/08782* (2013.01); *G03G 9/08795* (2013.01); *G03G 9/09708* (2013.01); *G03G 9/09725* (2013.01)

(58) Field of Classification Search
CPC ..... G03G 9/08797; G03G 9/08755; G03G 9/0819; G03G 9/09725; G03G 9/09716; G03G 9/09708; G03G 9/08782; G03G 9/08704; G03G 9/0825
USPC ..... 430/108.1, 108.7, 108.8, 110.1
See application file for complete search history.

(56) References Cited

U.S. PATENT DOCUMENTS

| | | | | |
|---|---|---|---|---|
| 5,976,754 | A * | 11/1999 | Asada et al. | 430/108.8 |
| 6,326,114 | B1 * | 12/2001 | Itakura et al. | 430/108.3 |
| 8,232,034 | B2 | 7/2012 | Kang et al. | |
| 2002/0115011 | A1 | 8/2002 | Komoto et al. | |
| 2005/0245694 | A1 * | 11/2005 | Matsumura et al. | 525/437 |
| 2006/0093943 | A1 * | 5/2006 | Shu | G03G 9/081 430/108.23 |
| 2007/0212631 | A1 * | 9/2007 | Abe et al. | 430/109.3 |
| 2008/0124644 | A1 * | 5/2008 | Liu et al. | 430/109.2 |
| 2008/0153022 | A1 * | 6/2008 | Choi | G03G 9/08755 430/108.7 |
| 2012/0141181 | A1 * | 6/2012 | Bisaiji et al. | 399/390 |

FOREIGN PATENT DOCUMENTS

| | | | | |
|---|---|---|---|---|
| JP | 10-293415 | | 11/1998 | |
| JP | 2002-214829 | | 7/2002 | |
| JP | 2003131419 | * | 5/2003 | G03G 9/08 |
| KR | 10-2000-0009649 | | 2/2000 | |
| KR | 10-2009-0008836 | | 1/2009 | |

OTHER PUBLICATIONS

Machine English language translation of JP 3003131419, May 9, 2003.*

* cited by examiner

*Primary Examiner* — Hoa V Le
(74) *Attorney, Agent, or Firm* — Staas & Halsey LLP

(57) ABSTRACT

A toner to develop electrostatic latent images which uses an appropriate combination of a high molecular weight binder resin and a low molecular weight binder resin, an appropriate amount of a releasing agent, and a combination of silica particles and iron oxide particles as external additives, and thus has the following effects: the toner may reduce a generation amount of ultra-fine particles (UFPs) and have enhanced fluidity, charging uniformity, charging stability, transfer efficiency, fixability, durability and a cleaning ability.

16 Claims, No Drawings

TONER TO DEVELOP ELECTROSTATIC LATENT IMAGES

CROSS-REFERENCE TO RELATED APPLICATIONS

This application claims the benefit of Korean Patent Application No. 10-2013-0129567, filed on Oct. 29, 2013, in the Korean Intellectual Property Office, the disclosure of which is incorporated herein in its entirety by reference.

BACKGROUND OF THE INVENTION

1. Field of the Invention

One or more exemplary embodiments of the present inventive concept relate to an electrophotographic toner, and more particularly, to a toner to develop electrostatic latent images.

2. Description of the Related Art

Printing devices such as printers and copiers require extreme performances. Printers that exhibit extreme performances provide full-color. Such printers have a very fast printing speed. Images printed by printers with extreme performances have excellent image quality. The printers with extreme performances are compact, inexpensive, and environmentally friendly. In order to obtain physical properties of electrophotographic toner for meeting such a trend, technology to control a shape and surface of toner particles has become more important than ever before.

As reported in N. Englert. *Fine particles and human health—a review of epidemiological studies. Toxicology Letters* 149 (2004), pp. 235-242, some sub-micrometer sized particles may be environmentally harmful to human bodies in outdoor and indoor environments.

In particular, ultra-fine particles (UFPs), which are nanoparticles having a typical size of 5 to less than 1000 nm, are very dangerous. Recently, among generators of UFPs produced indoor, printers have received most attention. UFPs generated by printers are affected by several factors such as structures of printers, lifespan of printers, lifespan of toner cartridges, the number of printings, types of printing media, types of toner, and the like. According to the Blue Angel eco-label for office equipment with printing function (RAL-UZ-171) standard, indoor environmental regulations on printers have been tightened and, for example, the Blue Angel label is awarded to printers only when printers discharge UFPs within a particular range.

Among properties required of toner in addition to such environmental issues, durability is related to a printing speed of printers. In general, as the printing speed of printers increases, the number of times a shearing force is exerted on toner increases. Thus, demand for high durability of toner is on the rise. To realize compact and eco-friendly printers, the amount of untransferred toner has to be reduced. In this regard, improvement of a charging uniformity and transferability of toner is required. In order to obtain high quality print images, improvements in charging stability, transferability, and cleaning ability of toner are required.

Improvements in surface characteristics of toner particles are required to give excellent charging uniformity, charging stability, transferability, and cleaning ability to the toner particles. One of the most important factors affecting the surface characteristics of toner particles may be an external additive that is added to the surface of toner particles. One of the main functions of the external additive is to help toner to maintain fluidity by preventing the toner particles from attaching to each other. External additives may also affect a charging uniformity, a charging stability, transferability, and a cleaning ability. A silica powder or a titanium oxide powder is mainly used as an external additive.

However, conventional external additives are known to be unfavorable in terms of obtaining charging uniformity. For example, fumed silica, which is the most commonly used external additive, has a very strong negative polarity. Accordingly, an excessive charge-up phenomenon may frequently occur in a toner that has fumed silica externally added thereto.

A method of externally adding titanium oxide particles, in addition to the fumed silica, to prevent excessive frictional charging due to the excessive charge-up phenomenon caused by the fumed silica has been tried. However, since titanium oxide has a low electric resistance and a good charge exchangeability, reverse or weak charged toner may be easily produced. Thus, when toner is externally added with silica, charging uniformity of the toner may be reduced.

Silica particles may be porous. In addition, silica particles may have hydrophilic surfaces. If toner that is externally added with silica particles having high porosity and highly hydrophilic surfaces is used in a high-temperature and high-humidity environment, such a toner may not be well charged due to excessive absorption of moisture, which serves as an electrical conductor. On the other hand, toner that is externally added with the silica particles is generally excessively charged in a low-temperature and low-humidity environment. That is, charging stability of toner externally added with the silica particles, which varies depending on the environment, may be deteriorated.

To address environmental charging stability degradation due to moisture, silica particles or titanium oxide particles that are surface-treated with a surface treating agent such as hydrophobic silicone oil or a hydrophobic silane coupling agent may be used as an external additive. However, if such external additive particles treated with such a surface treating agent are used, cohesiveness between toner particles increases, and thus, fluidity of toner may be rapidly degraded.

In a method of manufacturing fumed silica particles, aggregation of silica particles occurs frequently. The aggregation degrades dispersibility of the fumed silica particles. If an external additive with poor dispersibility is used, fluidity, anti-caking ability, fixability, and cleaning ability of toner obtained as a result may also be degraded.

Thus, it is difficult to provide a toner capable of addressing the UFP emission problem while having enhanced fluidity, charging uniformity, charging stability, transferability, fixability or fusibility durability and cleaning ability.

SUMMARY OF THE INVENTION

One or more embodiments of the present inventive concept include a toner to develop electrostatic latent images which is capable of reducing the amount of ultra-fine particles (UFPs) generated from a printer and has surface characteristics that may simultaneously enhance fluidity, charging uniformity, charging stability, transferability, fixability, durability, and cleaning ability.

Additional features and utilities of the present general inventive concept will be set forth in part in the description which follows and, in part, will be obvious from the description, or may be learned by practice of the general inventive concept.

Exemplary embodiments of the present inventive concept provide a toner to develop electrostatic latent images, the toner including a plurality of toner particles, wherein the toner particles include: core particles including a binder resin, a colorant, and a releasing agent; and an external additive attached to outer surfaces of the core particles and including silica particles and iron oxide particles, the toner has an endothermic peak by melting of the releasing agent and a stepwise endothermic curve in a second heating curve which is obtained by conducting a differential scanning calorimetry (DSC) measurement of the toner, and a melting temperature Tm determined as a location of the top of the endothermic peak, a glass transition temperature Tg determined as a central point of a linear portion in the stepwise endothermic curve going through glass transition, and a heat of melting off determined as an area of the endothermic peak satisfy the following conditions:

$$70° \text{ C.} \leq Tm \leq 75° \text{ C.} \quad (1),$$

$$0.2 \text{ J/g} \leq \Delta H \leq \text{J/g} \quad (2), \text{ and}$$

$$58° \text{ C.} \leq Tg \leq 62° \text{ C.} \quad (3).$$

In exemplary embodiments, a softening point $T_{1/2}$ of the toner, a temperature $T_{20K}$ at which a viscosity of the toner is 20,000 Pa·S, and a temperature $T_{50K}$ at which the viscosity of the toner is 50,000 Pa·S may further satisfy the following conditions:

$$132° \text{ C.} \leq T_{1/2} \leq 136° \text{ C.} \quad (4),$$

$$117° \text{ C.} \leq T_{20K} \leq 121° \text{ C.} \quad (5), \text{ and}$$

$$128° \text{ C.} \leq T_{50K} \leq 132° \text{ C.} \quad (6).$$

In exemplary embodiments, an intensity of iron [Fe] and an intensity of silicon [Si] measured by X-ray fluorescence (XRF) spectrometry of the toner may further satisfy the following conditions:

$$0.0001 \leq [Si]/[Fe] \leq 0.004 \quad (7).$$

In exemplary embodiments, the toner may have a dielectric loss factor of 0.032 to 0.042.

In exemplary embodiments, the binder resin may include a mixture of a high molecular weight polyester binder resin having a number average molecular weight of about 100,000 to about 500,000 g/mol and a low molecular weight polyester binder resin having a number average molecular weight of about 1,000 to less than about 100,000 g/mol in a weight ratio of 90:10 to 10:90.

In exemplary embodiments, the releasing agent may be a carnauba-based wax.

In exemplary embodiments, the toner may be used in a non-magnetic one-component image developing method.

Exemplary embodiments of the present inventive concept also provide a toner to develop electrostatic latent images, the toner comprising a plurality of toner particles, wherein the toner particles comprise: core particles comprising a binder resin, a colorant, and a releasing agent; and an external additive attached to outer surfaces of the core particles and comprising silica particles and iron oxide particles, wherein a softening point $T_{1/2}$ of the toner, a temperature $T_{20K}$ at which a viscosity of the toner is 20,000 Pa·S, and a temperature $T_{50K}$ at which the viscosity of the toner is 50,000 Pa·S satisfy the following conditions: $132° \text{ C.} \leq T_{1/2} \leq 136° \text{ C.}$, $117° \text{ C.} \leq T_{20K} \leq 121° \text{ C.}$, and $128° \text{ C.} \leq T_{50K} \leq 132° \text{ C.}$ Exemplary embodiments of the present inventive concept also provide a toner to develop electrostatic latent images, the toner comprising a plurality of toner particles, wherein the toner particles comprise: core particles comprising a binder resin, a colorant, and a releasing agent; and an external additive attached to outer surfaces of the core particles and comprising silica particles and iron oxide particles, wherein an intensity of iron [Fe] and an intensity of silicon [Si] measured by X-ray fluorescence (XRF) spectrometry of the toner satisfy the following conditions: $0.0001 \leq [Si]/[Fe] \leq 0.004$.

Exemplary embodiments of the present inventive concept also provide a toner to develop electrostatic latent images, the toner comprising a plurality of toner particles, wherein the toner particles comprise: core particles comprising a binder resin, a colorant, and a releasing agent; and an external additive attached to outer surfaces of the core particles and comprising silica particles and iron oxide particles, wherein the binder resin comprises a mixture of a high molecular weight polyester binder resin having a number average molecular weight of about 100,000 to about 500,000 g/mol and a low molecular weight polyester binder resin having a number average molecular weight of about 1,000 to less than about 100,000 g/mol in a weight ratio of 90:10 to 10:90.

DETAILED DESCRIPTION OF THE PREFERRED EMBODIMENTS

Reference will now be made in detail to embodiments of the invention. In this regard, the present embodiments may have different forms and should not be construed as being limited to the descriptions set forth herein. Accordingly, the embodiments are merely described below to explain aspects of the present description. As used herein, the term "and/or" includes any and all combinations of one or more of the associated listed items. Expressions such as "at least one of" or "at least two of," when preceding a list of elements, modify the entire list of elements and do not modify the individual elements on the list.

Hereinafter, a toner to develop electrostatic latent images according to an embodiment of the present inventive concept will be described in detail.

The toner to develop electrostatic latent images according to an embodiment of the present inventive concept includes a plurality of toner particles. The toner particles include core particles including a binder resin, a colorant, and a releasing agent; and an external additive that is attached to outer surfaces of the core particles.

The core particles include the binder resin, the colorant, and the releasing agent. The binder resin may include, for example, but are not limited thereto, a styrenic resin, an acrylic resin, a vinyl resin, a polyolefin resin, a polyether-based polyol resin, a phenolic resin, a silicone resin, a polyester resin, an epoxy resin, a polyamide resin, a polyurethane resin, a polybutadiene resin, or a mixture thereof.

The styrenic resin may be, for example, polystyrene; a homopolymer of a substituted styrene such as poly-p-chlorostyrene or polyvinyltoluene; a styrene-based copolymer such as styrene-p-chlorostyrene copolymer, styrene-vinyl toluene copolymer, styrene-vinyl naphthalene copolymer, styrene-acrylic acid ester copolymer, styrene-methacrylic acid ester copolymer, styrene-methyl a-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, or styrene-acrylonitrile-indene copolymer; or a mixture thereof.

The acrylic resin may be, for example, but are not limited thereto, polyacrylic acid, polymethacrylic acid, polymethyl methacrylate, polymethyl a-chloromethacrylate, or a mixture thereof.

The vinyl resin or the polyolefin resin may be, for example, but are not limited thereto, polyvinyl chloride, polyethylene, polypropylene, polyacrylonitrile, polyvinyl acetate, or a mixture thereof.

The polyester resin may be prepared by direct esterification or transesterification reaction of an aliphatic, an alicyclic or an aromatic polycarboxylic acid containing two or more carboxylic group or an alkyl ester thereof with a polyhydric alcohol. The polyhydric carboxylic acid may include, but are not limited thereto, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and/or cyclohexanecarboxylic acid. In addition, examples of polyhydric carboxylic acids having more than two hydroxyl groups in addition to the dicarboxylic acid include, but are not limited thereto, trimellitic acid, pyromellitic acid, naphthalene tricarboxylic acid, naphthalene tetracarboxylic acid, pyrene tricarboxylic acid, and pyrene tetracarboxylic acid. In addition, derivatives of these carboxylic acids, such as acid anhydrides, acid chlorides, esters, or the like, may be used. Among these, terephthalic acid or a lower ester thereof, diphenylacetic acid, cyclohexane dicarboxylic acid, or the like may specifically be used. The lower ester indicates an ester terephthalic acid with a $C_1$-$C_8$ aliphatic alcohol. Examples of polyhydric alcohols, i.e., polyols, include aliphatic diols or triols, such as ethylene glycol, diethylene glycol, triethylene glycol, propylene glycol, butanediol, hexanediol, neopentyl glycol, glycerin, and the like; alicyclic diols such as cyclohexanediol, cyclohexanedimethanol, hydrogenated bisphenol A, and the like; and aromatic diols such as ethylene oxide adducts of bisphenol A, propylene oxide adducts of bisphenol A, and the like. These polyols may be used alone or in a combination of at least two thereof. Among these, aromatic diols and alicyclic diols may specifically be used and, in particular, aromatic diols may be used. To secure good fixability of the toner particles, trihydric or higher polyols (e.g., glycerin, trimethylolpropane, and pentaerythritol) may be used in combination with diols so as to form a cross-linked structure or a branched structure.

The binder resin may have a number average molecular weight of, for example, about 1,000 to about 700,000 g/mol or about 10,000 to about 500,000 g/mol. The binder resin used herein may be a combination of a high molecular weight binder resin and a low molecular weight binder resin in an appropriate ratio. The high molecular weight binder resin may have a number average molecular weight of, for example, about 100,000 to about 500,000 g/mol, and the low molecular weight binder resin may have a number average molecular weight of, for example, about 1,000 to less than about 100,000 g/mol. These two binder resins with different molecular weights may independently exhibit their functions. A low molecular weight binder resin contains relatively less molecular chain entanglement and thus may contribute to fixability and gloss. On the other hand, a high molecular weight binder resin contains relatively greater molecular chain entanglement and thus may maintain a certain level of elasticity even at high temperatures, which enables contribution to anti-hot offset properties. As such, it has been found that toner with enhanced charging uniformity, charging stability, transferability, fixability, durability and cleaning ability is obtained by mixing the high molecular weight binder resin and the low molecular weight binder resin in an appropriate ratio such that rheological properties of toner, such as glass transition temperature Tg, softening point $T_{1/2}$, $T_{20K}$, and $T_{50K}$ are controlled.

The colorant may be, for example, a black colorant, a yellow colorant, a magenta colorant, a cyan colorant, or a combination thereof.

The black colorant may be, for example, carbon black, aniline black, or a mixture thereof.

The yellow colorant may be, for example, a condensed nitrogen compound, an isoindolinone compound, an anthraquine compound, an azo metal complex, an allyl imide compound, or a mixture thereof. More particular non-limiting examples of the yellow colorant include "C.I. Pigment Yellow" 12, 13, 14, 17, 62, 74, 83, 93, 94, 95, 109, 110, 111, 128, 129, 147, 168, and 180.

The magenta colorant may be, for example, a condensed nitrogen compound, an anthraquine compound, a quinacridone compound, a base dye lake, a naphthol compound, a benzoimidazole compound, a thioindigo compound, a perylene compound, or a mixture thereof. More particular non-limiting examples of the magenta colorant include "C.I. Pigment Red" 2, 3, 5, 6, 7, 23, 48:2, 48:3, 48:4, 57:1, 81:1, 122, 144, 146, 166, 169, 177, 184, 185, 202, 206, 220, 221, and 254.

The cyan colorant may be, for example, a copper phthalocyanine compound or a derivative thereof, an anthraquine compound, a base dye lake, or a mixture thereof. More particular non-limiting examples of the cyan colorant include "C.I. Pigment Blue" 1, 7, 15, 15:1, 15:2, 15:3, 15:4, 60, 62, and 66.

The amount of the colorant in the core particles may be in a range of, for example, about 0.1 parts by weight to about 20 parts by weight, or about 2 parts by weight to about 10 parts by weight, based on 100 parts by weight of the binder resin.

The releasing agent may be, for example, a polyethylene-based wax, a polypropylene-based wax, a silicone-based wax, a paraffin-based wax, an ester-based wax, a carnauba-based wax, a metallocene-based wax, or a mixture thereof. Type of the wax may affect an amount of UFPs generated. When a paraffin-based wax is used, the generated amount of UFPs tends to relatively increase at the same toner fixing or fixing temperature. When a carnauba-based wax is used, the generated amount of UFPs tends to relatively decrease at the same toner fixing temperature.

The releasing agent may have a melting point in a range of, for example, about 50° C. to about 150° C. The amount of the releasing agent in the core particles may be in a range of, for example, about 1 part by weight to about 20 parts by weight, or about 1 part by weight to about 10 parts by weight, based on 100 parts by weight of the binder resin.

Currently, it is assumed that UFPs discharged from an imaging apparatus are mainly derived from a nano-sized external additive, a low molecular weight resin produced through pyrolysis, a wax material, and a complex thereof. The fact that UFPs are related to heat is supported by the fact that, when a fixing temperature of an imaging apparatus is reduced, the amount of UFPs discharged decreases. In addition, the fact that UFPs are related to toner is supported by the fact that, when printing is carried out with only a printing medium being supplied to an imaging apparatus without supplying toner, UFPs are hardly generated. Among components of toner, wax may have a decreased weight by heat and, since wax generally consists of a crystalline resin, and thus wax has a low melting point and evaporates with an increase in temperature. Thus, as the amount of wax decreases, UFP problems may be easily addressed.

In the present disclosure, a heat of melting ΔH, determined as an area of an endothermic peak by melting of the releasing agent in a second heating curve which is obtained by conducting a differential scanning calorimetry (DSC) measurement of the toner including the above-described wax, is controlled to 0.2 J/g to 0.4 J/g by reducing the amount of wax included as a releasing agent in the toner. When the heat of melting ΔH of the toner is less than 0.2 J/g, an anti-offset property of the toner tends to be deteriorated and, on the other hand, when the heat of melting ΔH of the toner exceeds 0.4 J/g, the amount of UFPs generated tends to increase.

Also, a toner fixing temperature is one of the important factors that affect the generated amount of UFPs. When the same wax is used, the generated amount of UFPs decreases with the toner fixing temperature decreasing. However, the toner fixing temperature is mainly affected by the binder resin, and there is a need to reduce the viscosity of toner in order to decrease the toner fixing temperature.

As described above, the inventors of the present disclosure have found that, when softening point $T_{1/2}$, $T_{20K}$ and $T_{50K}$ are controlled so as to satisfy conditions (4), (5) and (6) below, mainly, by mixing the high molecular weight binder resin and the low molecular weight binder resin in an appropriate ratio, all of the charging uniformity, charging stability, transferability, fixability, durability and cleaning ability of the toner may be enhanced.

$$132° \text{ C.} \leq T_{1/2} \leq 136° \text{ C.}, \quad (4)$$

$$117° \text{ C.} \leq T_{20K} \leq 121° \text{ C., and} \quad (5)$$

$$128° \text{ C.} \leq T_{50K} \leq 132° \text{ C.} \quad (6)$$

When the softening point $T_{1/2}$, which represents viscosity characteristics of toner, is less than 132° C., the durability of the toner may be aggravated. On the other hand, when the softening point $T_{1/2}$ exceeds 136° C., low-temperature fixability may be aggravated.

When $T_{20K}$, a temperature when the viscosity of toner is 20,000 Pa·S, is less than 117° C., the durability of the toner may be deteriorated. On the other hand, when $T_{20K}$ exceeds 121° C., low-temperature fixability may be deteriorated. When $T_{50K}$, a temperature when the viscosity of the toner is 50,000 Pa·S, is less than 128° C., the durability of the toner may be reduced. On the other hand, when $T_{50K}$ exceeds 132° C., low-temperature fixability of the toner may be reduced.

The core particles may be prepared by using, for example, a pulverization method, an aggregation method, or a spray method. The pulverization method may be performed by, for example, pulverizing after melting and mixing a binder resin, a colorant, and a releasing agent. The aggregation method may be performed by, for example, mixing a binder resin dispersion, a colorant dispersion, and a releasing agent dispersion; aggregating these particles of the binder resin, a colorant, and a releasing agent; and combining the resulting aggregates.

A volume average particle size of the core particles may be in a range of, for example, about 4 μm to about 20 μm, or about 5 μm to about 10 μm.

A shape of the core particles is also not particularly limited. As the shape of the core particles is closer to a sphere, charging stability of the toner and dot reproducibility of a print image may be more enhanced. For example, the core particles may have a sphericity in a range of, for example, about 0.90 to about 0.99.

The core particles are provided at outer surfaces thereof with an external additive attached thereto. The external additive includes silica particles and iron oxide particles.

The silica particles may be, for example, fumed silica, sol-gel silica, or a mixture thereof. When the primary particle size of the silica particles is too large, toner particles externally added therewith may be relatively difficult to pass through a developing blade. Accordingly, a selection phenomenon of toner may occur. That is, as a period of a toner cartridge having been used increases, a particle size of the toner particles remaining in the toner cartridge gradually increases. As a result, a quantity of charge of toner decreases and thus the thickness of a toner layer developing an electrostatic latent image increases. In addition, when the primary particle size of the silica particles is too large, a probability of the silica particles separating from the core particles may relatively increase due to stress applied to the toner particles from a member such as a feed roller. The separated silica particles may contaminate a charging member or a latent image carrier. On the other hand, when the primary particle size of the silica particles is too small, the silica particles are likely to be embedded into the core particles due to shearing stress of a developing blade that is applied to the toner particles. If the silica particles are embedded into the core particles, the silica particles lose their functionality as an external additive. Accordingly, adhesion between the toner particles and the surface of a photoconductor may be undesirably increased. This may lead to reduction in cleaning ability and transferability of the toner. For example, a volume average primary particle size of the silica particles may be in a range of about 5 nm to about 80 nm, in particular in a range of about 30 nm to 80 nm, or in a range of about 60 nm to about 80 nm.

The iron oxide particles may enhance charge distribution and charging uniformity of toner and prevent an excess of charge accumulation of the silica particles. Iron oxide has a relatively lower electrical resistance than silica and thus may prevent an excess of charge accumulation of toner. In addition, iron oxide has a relatively larger particle size and thus may increase developing ability and transferability of the toner. For example, a volume average primary particle size of the iron oxide particles may be in a range of about 20 nm to about 100 nm, in a range of about 30 nm to about 90 nm, or in a range of about 40 nm to about 80 nm.

The external additive may include, for example, iron oxide particles having a volume average primary particle size of about 20 nm to about 100 nm and small particle size silica particles having a volume average primary particle size of about 5 nm to about 50 nm. The small particle size silica particles have a wide surface area and thus further enhance charging stability of the toner particles. In addition, the small particle size silica particles are attached to the core particles in a state in which the small particle size silica particles are disposed between the iron oxide particles and thus, even though shearing stress is applied to the toner particles from the outside, the shearing stress is not transmitted to the small particle size silica particles. That is, the shearing stress applied to the toner particles from the outside is concentrated on large particle size iron oxide particles. Accordingly, the small particle size silica particles are not embedded in the core particles and may retain charging stability enhancing effects.

The silica particles may be hydrophobically treated with, for example, silicone oils, silanes, siloxanes, or silazanes. A degree of hydrophobicity of each of the silica particles may be in a range of about 10 to about 90.

In the toner, the amounts of silica and iron oxide added as external additives may be such that the amount of silica is in a range of about 0.1 parts by weight to about 3 parts by weight and the amount of iron oxide is in a range of about 0.1 parts by weight to about 0.5 parts by weight, respectively, based on 100 parts by weight of the core particles.

As described above, the toner according to the embodiment of the present disclosure satisfies thermal properties shown in the following conditions (1), (2) and (3) by using a combination of the high molecular weight binder resin and the low molecular weight binder resin in an appropriate ratio, an appropriate amount of the releasing agent, and a combination of the silica particles and the iron oxide particles as external additives. In particular, the toner has an endothermic peak by melting of the releasing agent and a stepwise endothermic curve in a second heating curve which is obtained by conducting a differential scanning calorimetry (DSC) measurement of the toner, and a melting temperature Tm determined as a location of the top of the endothermic peak, a glass transition temperature Tg determined as a central point of a linear portion in the stepwise endothermic curve going through glass transition, and a heat of melting ΔH determined as an area of the endothermic peak satisfy the following conditions:

$$70° \text{ C.} \leq Tm \leq 75° \text{ C.}, \quad (1)$$

$$\text{J/g} \leq \Delta H \leq 0.4 \text{ J/g, and} \quad (2)$$

$$58° \text{ C.} \leq Tg \leq 62° \text{ C.} \quad (3)$$

To simultaneously enhance charging uniformity, charging stability, and transferability of the toner, an intensity of iron [Fe] and an intensity of silicon [Si] measured by X-ray fluorescence (XRF) spectrometry of the toner may satisfy the following conditions: 0.0001≤[Si]/[Fe] 0.004. When the ratio of [Si]/[Fe] is less than 0.0001, background contamination may be severe and developing ability and transferability may be deteriorated. On the other hand, when the ratio of [Si]/[Fe] exceeds 0.004, fluidity of the toner may be reduced and thus toner supply properties may be reduced. In addition, contamination caused by cleaning deterioration of a charging member or a latent image carrier may easily occur. Thus, the contents of iron and silicon of the toner may advantageously satisfy the above-described condition.

The [Fe] and [Si] of the toner, which are indexes of the contents of iron and silicon of the toner, are mainly derived from iron oxide and silica, respectively, used as external additives in a one-component nonmagnetic toner. Thus, the intensity ratio of [Si]/[Fe] may be appropriately selected by adjusting the amounts of silica and iron oxide added as external additives. The intensities of iron [Fe] and silicon [Si] of the toner may be measured under conditions described below.

The toner may be prepared by attaching external additive particles to surfaces of the core particles. The attachment may be performed using, for example, a powder mixing apparatus. Non-limiting examples of the powder mixing apparatus include a Henshell mixer, a V-shape mixer, a ball mill, or a Nauta mixer.

The toner to develop electrostatic latent images according to exemplary embodiments of the present inventive concept may have a dielectric loss factor of about 0.032 to about 0.042. When the dielectric loss factor of the toner is too small, a quantity of charge of the toner in a low-humidity environment rapidly increases, and thus charge-up may be caused and an image density may be decreased. On the other hand, when the dielectric loss factor of the toner is too large, the toner may not be charged enough, and thus a quantity of charge may be very low or charge may be widely distributed. The dielectric loss factor of the toner may be closely related to a type and an added amount of the external additive.

The dielectric loss factor of the toner is measured under the following conditions. First, 8 g of a toner sample is prepared and the toner sample is pressed by a presser in a mold for a disk having a diameter of 50 mm. A final thickness of the pressed toner is about 3.9 mm. The prepared toner sample was analyzed using a Precision Component Analyzer (Model: 6440B) manufactured by Wayne Kerr Electronics with a voltage of 5.00 Vac and a frequency of 100 KHz and the dielectric loss factor of the toner sample is calculated using Equation (1) below.

$$\tan \delta = \in''/\in' \quad (1)$$

Here, ∈" is a dielectric loss factor, tan δ is a loss tangent, and ∈' is a dielectric constant.

The toner to develop electrostatic latent images according to exemplary embodiments of the present inventive concept may have a degree of hydrophobicity of about 30 to about 60. When the degree of hydrophobicity of the toner is too small, moisture is attached to the toner in a high-humidity environment, and thus a quantity of charge is decreased and, accordingly, the amount of the toner consumed increases, and supplying ability of the toner may be reduced because fluidity of the toner is decreased due to the moisture intake. On the other hand, when the degree of hydrophobicity of the toner is too large, filming on a surface of a photoconductor may be caused due to an excess of a surface treating agent. The degree of hydrophobicity of the toner may be controlled by a type and an amount of a surface treating agent of the external agent.

The degree of hydrophobicity of the toner refers to a value measured by using a methanol titration method known in the art. For example, the degree of hydrophobicity of the toner may be measured as follows. To a glass beaker with an internal diameter of 7 cm, a capacity of 2 L or more, and containing 100 ml of ion exchange water is added 0.2 g of toner particles to measure the degree of hydrophobicity, and the resulting solution is stirred with a magnetic stirrer. A tip part of a burette containing methanol is immersed in the suspension, into which 20 ml of methanol is dripped with stirring, the stirring is stopped after 30 seconds, and 1 minute after stopping the stirring the state of the suspension is observed. This operation is repeatedly performed. When silica particles do not float on the water surface 1 minute after stopping the stirring, the total added amount of methanol is taken as Y (unit: ml) and a value obtained by the following formula is calculated as the degree of hydrophobicity. The water temperature in the beaker is adjusted to about 20° C.±1° C. to perform the measurement. The degree of hydrophobicity=[Y/(100+Y)]×100].

EXAMPLES

Example 1

Preparation of Toner 50 parts by weight of a high molecular weight polyethylene teraphthalate resin H (manufactured by SAMYANG CHEMICAL INDUSTRIES CO., LTD., product name: 8035TR, hereinafter, referred to as resin H), 50 parts by weight of a low molecular weight polyethylene teraphthalate resin L (manufactured by SAMYANG CHEMICAL INDUSTRIES CO., LTD., product name: 8025TR, hereinafter, referred to as resin L), 2 parts by weight of carnauba wax (manufactured by S. KATO & CO., product name: Tokusei No. 1, hereinafter, referred to as wax A), 2 parts by weight of a charging control agent (manufactured by HODOGAYA, product name: T77), and 6 parts by weight of carbon black (manufactured by CABOT CORPORATION, product name: Mogul-L) were pre-mixed in a Henschel mixer (manufacturer: MITSUI MINING CO., model name: FM20C/1). Subsequently, the pre-mixture was added to a hopper of a twin screw extruder (manufactured by IKEGAI CORP., model name: PCM 30) and melted and kneaded. The kneaded mixture was cooled while continuously ejected via nozzles and coarse-pulverized using a hammer mill. Thereafter, the coarse-pulverized mixture was finely pulverized using a jet mill (manufactured by HOSOKAWA MICRON LIMITED, model name: TSG). The finely pulverized mixture was sorted using a classifier (manufactured by HOSOKAWA MICRON LIMITED, model name: TTSP) to obtain core particles having a volume average particle diameter of about 8 μm.

100 parts by weight of the core particles was mixed with two kinds of nano-sized hydrophobic silica particles and nano-sized iron oxide particles, listed in Table 1 below, in an external adder (manufactured by DAEWHA TECH IND., model name: KMLS2K) and the mixture was stirred to attach the external additives to surfaces of the core particles. The stirring process was performed at about 2000 rpm for 30 seconds and at about 6000 rpm for 3 minutes.

TABLE 1

| | Product name | Surface area (m2/g) | Manufacturer | Amount (parts by weight) |
|---|---|---|---|---|
| Hydrophobic silica particles 1 | R972 | 140 | Nippon Aerosil Co. LTD | 1.5 |
| Hydrophobic silica particles 2 | RX50 | 50 | Nippon Aerosil Co. LTD | 1 |
| Iron oxide particles | SMT-02H | 30 | Cosmo AM&T | 0.5 |

Examples 2 to 7 and Comparative Examples 1 to 2 and 5 to 6

Preparation of Toner

Externally added toners were prepared in the same manner as in Example 1, except that a mixing ratio of resin H to resin L and the amount of wax A added were changed as shown in Table 3 below.

Comparative Examples 3 and 4

Preparation of Toner

Externally added toners were prepared in the same manner as in Example 1, except that 70 parts by weight of resin H and 30 parts by weight of resin L were used and a polypropylene wax (product name: Viscol 550P, manufactured by SANYO CHEMICAL INDUSTRIES LTD., used in Comparative Example 3, hereinafter referred to as wax B) or a paraffin wax (product name: PARAFINWAX-155, manufactured by NIPPON SEIRO CO., LTD., used in Comparative Example 4, hereinafter referred to as wax C).

Examples 8 and 9 and Comparative Examples 7 and 8

Preparation of Toner

Externally added toners were prepared in the same manner as in Example 1, except that 70 parts by weight of resin H and 30 parts by weight of resin L were used and the amounts of the external additives added were changed as shown in Table 2 below.

TABLE 2

| | Example 8 (parts*) | Example 9 (parts*) | Comparative Example 7 (parts*) | Comparative Example 8 (parts*) |
|---|---|---|---|---|
| Hydrophobic silica particles 1 | 1.5 | 1.5 | 1.5 | 1.5 |
| Hydrophobic silica particles 2 | 1 | 1 | 1 | 0 |
| Iron oxide particles | 0.05 | 1 | 0 | 0.5 |

*parts by weight

Compositions of the toners prepared according to Examples 1 to 9 and Comparative Examples 1 to 8 and physical properties thereof are shown in Tables 3 and 4 below.

TABLE 3

| | Resin H (parts*) | Resin L (parts*) | Wax A (parts*) | Wax B (parts*) | Wax C (parts*) | [Si]/[Fe] | Dielectric loss factor | ΔH | Tm | Tg | $T_{1/2}$ | $T_{20K}$ | $T_{50K}$ |
|---|---|---|---|---|---|---|---|---|---|---|---|---|---|
| Example 1 | 50 | 50 | 2 | — | — | 0.001 | 0.033 | 0.3 | 71~75 | 62 | 132 | 117 | 128 |
| Example 2 | 60 | 40 | 2 | — | — | 0.001 | 0.033 | 0.3 | 71~75 | 61 | 133 | 118 | 129 |
| Example 3 | 70 | 30 | 2 | — | — | 0.001 | 0.033 | 0.3 | 71~75 | 60 | 134 | 119 | 130 |
| Example 4 | 80 | 20 | 2 | — | — | 0.001 | 0.033 | 0.3 | 71~75 | 59 | 135 | 120 | 131 |
| Example 5 | 90 | 10 | 2 | — | — | 0.001 | 0.033 | 0.3 | 71~75 | 58 | 136 | 121 | 132 |
| Comparative Example 1 | 100 | 0 | 2 | — | — | 0.001 | 0.033 | 0.3 | 71~75 | 57 | 137 | 122 | 133 |
| Comparative Example 2 | 40 | 60 | 2 | — | — | 0.001 | 0.033 | 0.3 | 71~75 | 63 | 131 | 116 | 127 |
| Example 6 | 70 | 30 | 1 | — | — | 0.001 | 0.033 | 0.2 | 71~75 | 60 | 134 | 119 | 130 |
| Example 7 | 70 | 30 | 2.5 | — | — | 0.001 | 0.033 | 0.4 | 71~75 | 60 | 134 | 119 | 130 |

TABLE 3-continued

| | Resin H (parts*) | Resin L (parts*) | Wax A (parts*) | Wax B (parts*) | Wax C (parts*) | [Si]/[Fe] | Dielectric loss factor | ΔH | Tm | Tg | $T_{1/2}$ | $T_{20K}$ | $T_{50K}$ |
|---|---|---|---|---|---|---|---|---|---|---|---|---|---|
| Comparative Example 3 | 70 | 30 | — | 2 | — | 0.001 | 0.033 | 1.7 | 66~70 | 60 | 134 | 119 | 130 |
| Comparative Example 4 | 70 | 30 | — | — | 2 | 0.001 | 0.033 | 3.5 | 76~80 | 60 | 134 | 119 | 130 |
| Comparative Example 5 | 70 | 30 | 0.5 | — | — | 0.001 | 0.033 | 0.1 | 71~75 | 60 | 134 | 119 | 130 |
| Comparative Example 6 | 70 | 30 | 3 | — | — | 0.001 | 0.033 | 0.7 | 71~75 | 60 | 134 | 119 | 130 |
| Example 8 | 70 | 30 | 2 | — | — | 0.0001 | 0.032 | 0.3 | 71~75 | 60 | 134 | 119 | 130 |
| Example 9 | 70 | 30 | 2 | — | — | 0.004 | 0.042 | 0.3 | 71~75 | 60 | 134 | 119 | 130 |
| Comparative Example 7 | 70 | 30 | 2 | — | — | 0 | 0.031 | 0.3 | 71~75 | 60 | 134 | 119 | 130 |
| Comparative Example 8 | 70 | 30 | 2 | — | — | 0.005 | 0.031 | 0.3 | 71~75 | 60 | 134 | 119 | 130 |

*parts by weight

TABLE 4

| | Fixability | Durability | Anti-hot offset properties | Amount of UFP generated | Background contamination of photoconductor | Developing ability | Transferability | Fluidity |
|---|---|---|---|---|---|---|---|---|
| Example 1 | ◎ | ○ | ○ | ○ | ○ | ◎ | ◎ | ○ |
| Example 2 | ○ | ○ | ○ | ○ | ○ | ◎ | ◎ | ○ |
| Example 3 | ○ | ◎ | ○ | ○ | ○ | ◎ | ◎ | ○ |
| Example 4 | Δ | ◎ | ○ | ○ | ○ | ◎ | ◎ | ○ |
| Example 5 | Δ | ◎ | ○ | ○ | ○ | ◎ | ◎ | ○ |
| Comparative Example 1 | X | ◎ | ○ | ○ | ○ | ◎ | ◎ | ○ |
| Comparative Example 2 | ◎ | X | ○ | ○ | ○ | ◎ | ◎ | ○ |
| Example 6 | ○ | ◎ | Δ | ○ | ○ | ◎ | ◎ | ○ |
| Example 7 | ○ | ◎ | ◎ | Δ | ○ | ◎ | ◎ | ○ |
| Comparative Example 3 | ○ | ◎ | ○ | X | ○ | ◎ | ◎ | ○ |
| Comparative Example 4 | ○ | ◎ | ○ | X | ○ | ◎ | ◎ | ○ |
| Comparative Example 5 | ○ | ◎ | X | ◎ | ○ | ◎ | ◎ | ○ |
| Comparative Example 6 | ○ | ◎ | ◎ | X | ○ | ◎ | ◎ | ○ |
| Example 8 | ○ | ◎ | ○ | ○ | ○ | ◎ | ◎ | ○ |
| Example 9 | ○ | ◎ | ○ | ○ | ◎ | ◎ | ◎ | ○ |
| Comparative Example 7 | ○ | ◎ | ○ | ○ | X | Δ | Δ | ◎ |
| Comparative Example 8 | ○ | ◎ | ○ | ○ | ○ | ○ | ○ | X |

Properties of the toner of Examples 1 to 9 and Comparative Examples 1 to 8 shown in Tables 3 and 4 are evaluation results obtained using the following test methods.

Measurement of Intensity Ratio of [Si]/[Fe]

An intensity ratio of silicon [Si] to iron [Fe] of the toner was measured by X-ray fluorescence (XRF) spectrometry as follows.

First, 3 g±0.01 g of a toner sample was compression-molded using a compression molder under the following conditions: a load of 2 t and a compression time of 10 seconds. The intensity of iron [Fe] (unit: cps/pA) and the intensity of silicon [Si] (unit: cps/μA) were measured from fluorescent X-rays generated from the toner sample using an Energy Dispersive X-ray Spectrometer (Model Name: EDX-720) manufactured by SHIMADZU CORPORATION. Measurement conditions were a tube voltage of 50 kV and a tube current of 23 μA.

Measurement of Dielectric Loss Factor

The dielectric loss factor of the toner was measured as follows. First, 8 g of a toner sample was prepared and the toner sample was pressed using a presser in a mold for a disk having a diameter of 50 mm. A final thickness of the pressed toner is about 3.9 mm. The prepared toner sample was analyzed using a Precision Component Analyzer (Model: 6440B) manufactured by WAYNE KERR ELECTRONICS with a voltage of 5.00 Vac and a frequency of 100 KHz and the dielectric loss factor of the toner sample was calculated using Equation (1) below.

$$\tan \delta = \in''/\in' \quad (1)$$

Here, $\in'$ is a dielectric loss factor, tan δ is a loss tangent, and $\in'$ is a dielectric constant.

Measurement of Melting Temperature Tm, Heat of Melting ΔH, and Glass Transition Temperature Tg A differential scanning calorimetry (DSC) curve (thermogram) of 6 to 7 mg of a powder-type toner sample was obtained under the following heat profiles using a Differential Scanning calorimeter (model name: DSC Q2000, manufactured by TA INSTRUMENT) in a nitrogen gas atmosphere.

Primary heating: heating from 0° C. to 140° C. at a heating rate of 20° C./min, followed by being kept at 140° C. for 1 minute Cooling: cooling from 140° C. to 0° C. at a cooling rate of −10° C./min and thereafter kept for 1 minute, and Secondary heating: heating from 0° C. to 140° C. at a heating rate of 10° C./min.

The melting temperature of the toner was determined from a location of the top of an endothermic peak representing a crystalline melting in the DSC curve. In addition, the glass transition temperature Tg was determined from the center point of a linear portion in a stepwise endothermic curve (namely, a so-called 'baseline shift') representing a glass transition phenomenon in the DSC curve. The heat of melting ΔH was calculated from an area of the endothermic peak.

Measurement of Softening Point T1/2 and Temperatures T20K and T50K 1.5 g of a toner sample was heated at a heating rate of 6° C./min using a flow tester (model: CFD-500D, manufactured by SHIMADZU CORPORATION), and a load of 1.5 kg was applied thereto by a plunger to extrude the resulting toner sample from a nozzle having a diameter of 1.0 mm and a length of 1.0 mm. A displacement (y-axis) of the plunger in the flow tester was plotted as a function of temperature (x-axis). A temperature at which a half of the toner sample is ejected was defined as a softening point T1/2 of the toner sample.

In the flow test, a viscosity drop (y-axis) of the toner sample in the flow tester was plotted as a function of temperature (x-axis). A temperature at which the viscosity of the toner sample is 20,000 Pa·S was determined as T20K, and a temperature at which the viscosity of the toner sample is 50,000 Pa·S was determined as T50K.

Fixability Evaluation

Each of the toners of Examples 1 to 9 and Comparative Examples 1 to 8 was set in a cartridge of a printer of a non-contact non-magnetic one-component developing type (model: CLP-775, manufactured by SAMSUNG ELECTRONICS CO., LTD.,) in an environmental chamber with a temperature of 25° C. and a relative humidity of 55%, the amount of toner developed of a solid pattern image was adjusted to 0.70 mg/cm$^2$, and an unfixed image (2.5 cm×4 cm) was printed on a printing medium.

Under the conditions, the unfixed image produced on Xerox Exclusive 90 g/m2 A4 paper was fixed using a jig made by modifying a fixing part of the printer (CLP-775) by varying a fixing temperature from 100° C. to 190° C. In this regard, a process speed was about 190 mm/sec. A 3M tape (Scotch mending tape 810-3-15) was adhered to a surface of the fixed image, 500 g of a weight was reciprocated thereon five times, and the tape used was removed by applying a constant force of 100 kPa. Image densities before and after removing the tape were measured using a Macbeth-type reflection densitometer. A minimum temperature at which a change rate in image density at each temperature is 90% or greater was defined as a minimum fixing temperature. The fixability of each toner was evaluated by the following standards.

◎: minimum fixing temperature of less than 110° C.

○: minimum fixing temperature of 110° C. to less than 130° C.

Δ: minimum fixing temperature of 130° C. to less than 150° C.

x: minimum fixing temperature of 150° C. or greater

Anti-Hot Offset Property

An anti-hot offset property of the toner was evaluated in accordance with the measurement of the minimum fixing temperature, but the fixing process was performed using the fixing jig after forming an unfixed image using the printer (CLP-775) and transferring the toner image. Subsequently, visual observation was made to determine whether toner contamination occurred on the transfer medium when white paper as a transfer medium was transferred to a fixing unit under the same conditions, and this operation was repeatedly performed by gradually increasing a preset temperature of the fixing unit. In this regard, a minimum preset temperature at which contamination by toner occurred was defined as a hot-offset generating temperature.

◎: hot-offset generating temperature of 190° C. or higher

○: hot-offset generating temperature of 180° C. to less than 190° C.

Δ: hot-offset generating temperature of 170° C. to less than 180° C.

x: hot-offset generating temperature of less than 170° C.

Durability (Change with the Passage of Time)

Up to 7,000 sheets of paper were printed using a printer of a non-contact non-magnetic one-component developing type (model: CLP-775, manufactured by SAMSUNG ELECTRONICS CO., LTD.,) under conditions of 1% coverage. Changes in weight of the toner attached to a developing roller as the printing process was repeated were measured. Evaluation was performed as follows according to a change in weight of the toner per unit area of the developing roller after printing 7,000 sheets of paper with respect to the weight of the toner per unit area of the developing roller after first printing one sheet of paper.

◎: less than 10% increase in weight of the toner per unit area of the developing roller after printing 7,000 sheets of paper with respect to the initial toner weight ○: 10% to less than 20% increase in weight of the toner per unit area of the developing roller after printing 7,000 sheets of paper with respect to the initial toner weight Δ: 20% to less than 30% increase in weight of the toner per unit area of the developing roller after printing 7,000 sheets of paper with respect to the initial toner weight x: 30% or greater increase in weight of the toner per unit area of the developing roller after printing 7,000 sheets of paper with respect to the initial toner weight Measurement of Amount of UFPs Generated The amount of UFPs generated from a printer of a contact non-magnetic one-component developing type (model: M4020ND, manufactured by SAMSUNG ELECTRONICS CO., LTD.,) was measured according to a measurement method described in the RAL-UZ 171 standard. The measurement was performed using CPC 377500 apparatus (available from TSI Inc.) and measurement conditions are listed in Table 5 below.

TABLE 5

| Type of test chamber | Emission test chamber |
|---|---|
| Volume of test chamber (m$^3$) | 1 |
| Temperature in the vacant test chamber (° C.) | 23 |
| Relative humidity in the vacant test chamber (%) | 50 |
| Temperature in the test chamber during the pre-operating phase (° C.) | 22.8-23.1 |

TABLE 5-continued

| Type of test chamber | Emission test chamber |
|---|---|
| Relative humidity in the test chamber during the pre-operating phase (%) | 50.6-50.9 |
| Temperature (range) in the test chamber during the printing phase (° C.) | 22.8-22.4 |
| Relative humidity (range) in the test chamber during the printing phase (%) | 33.0-66.7 |
| Air exchange rate in the test chamber during the pre-operating phase ($h^{-1}$) | 1.0 |
| Air exchange rate in the test chamber during the printing phase ($h^{-1}$) | 4.0 |
| Ozone half-life in the vacant test chamber for n = 1 $h^{-1}$ (min) | 14.2 |
| Air pressure (Pa) | 100630 |

A black print master with 5% page coverage was used for the test pages when measuring the amount of UFPs generated. Evaluation was implemented according to the following criteria.

◎: $2.0\times10^{11}$ particles/10 min or less

○: greater than $2.0\times10^{11}$ to $3.0\times10^{11}$ particles/10 min

Δ: greater than $3.0\times10^{11}$ to $3.5\times10^{11}$ particles/10 min x: greater than $3.5\times10^{11}$ particles/10 min Background Contamination of Photoconductor Printing was performed using a printer of a non-contact non-magnetic one-component developing type (model: CLP-775, manufactured by SAMSUNG ELECTRONICS CO., LTD.) under conditions of 1% coverage. After printing 10 sheets of paper, three non-image regions on a photoconductor drum (i.e., electrophotographic photoreceptor) was taped. Optical densities at the three locations were measured and an average thereof was calculated. The optical density was measured using "Electroeye" Reflection Densitometer. Measurement results were evaluated according to the following criteria.

◎: optical density of less than 0.03

○: optical density of 0.03 to less than 0.05

Δ: optical density of 0.05 to less than 0.07 x: optical density of 0.07 or greater

Evaluation of Developing Property

Up to 7,000 sheets of paper were printed using a printer of a non-contact non-magnetic one-component developing type (model: CLP-775, manufactured by SAMSUNG ELECTRONICS CO., LTD.) under conditions of 1% coverage. After printing 1,000 sheets of paper, an image with a certain area was developed on an electrophotographic photoreceptor before the toner was transferred to an intermediate transfer member from the electrophotographic photoreceptor, and the weight of the toner per unit area of the electrophotographic photoreceptor was measured using a suction device equipped with a filter. In this regard, the weight of the toner per unit area on a developing roller was simultaneously measured and developing property was evaluated using the following method.

Developing efficiency (%)=weight of toner per unit area of electrophotographic photoreceptor/weight of toner per unit area of developing roller×100.

◎: developing efficiency of 90% or greater

○: developing efficiency of 80% to less than 90%

Δ: developing efficiency of 70% to less than 80% x: developing efficiency of 60% to less than 70%

Transferability Evaluation

Primary transferability was evaluated using a ratio of the weight of the toner per unit area of the intermediate transfer member after transferring the toner to the intermediate transfer member from the electrophotographic photoreceptor to the weight of the toner per unit area of the electrophotographic photoreceptor, obtained through evaluation of developing properties described above. In addition, secondary transferability was evaluated using a ratio of the weight of the toner per unit area on printing paper after the toner was transferred to the printing paper to the weight of the toner per unit area of the intermediate transfer member. In this regard, to evaluate transferability, the weight of the toner per unit area on printing paper was measured using an unfixed image.

Primary transfer efficiency=weight of toner per unit area of intermediate transfer member/weight of toner per unit area of electrophotographic photoreceptor.

Secondary transfer efficiency=weight of toner per unit area of printing paper/weight of toner per unit area of intermediate transfer member.

Transfer efficiency=primary transfer efficiency×secondary transfer efficiency.

Transferability of toner was evaluated according to the following criteria.

◎: transfer efficiency of 90% or greater

○: transfer efficiency of 80% to less than 90%

Δ: transfer efficiency of 70% to less than 80% x: transfer efficiency of 60% to less than 70%

Evaluation of Toner Fluidity

Cohesiveness was measured as follows to evaluate fluidity of the toner.

Equipment: Hosokawa micron powder tester PT-S

Amount of sample: 2 g

Amplitude: 1 mm dial 3 to 3.5

Sieves: 53 μm, 45 μm, and 38 μm

Vibration time: 120±0.1 seconds

After the toner samples were stored for 2 hours under the conditions of room temperature (20° C.) and relative humidity of 55±5%, the samples were sieved using each sieve under the above conditions, and changes in amount of the toner before and after sieving were measured to calculate the cohesiveness of the toner as follows.

[mass of powders remaining on 53 μm sieve/2 g]×100 (1)

[mass of powders remaining on 45 μm sieve/2 g]×100×(3/5) (2)

[mass of powders remaining on 38 μm sieve/2 g]×100×(1/5) (3)

Degree of cohesiveness(Carr's cohesion)=(1)+(2)+(3).

The fluidity of the toner was evaluated from the degree of cohesiveness measured as above according to the following criteria.

◎: degree of cohesiveness of 10 or less (Very good fluidity)

○: degree of cohesiveness of greater than 10 to 15 (good fluidity)

Δ: degree of cohesiveness of greater than 15 to 20 (little poor fluidity)

x: degree of cohesiveness of greater than 20 (very poor fluidity)

Referring to Tables 3 and 4, the toners of Examples 1 to 5 had a softening point T1/2 of 132° C. to 136° C. through adjustment of a mixing ratio of resin H and resin L and exhibited high fixability and durability, but had decreased durability as the mixed amount of the resin H decreased. This is also related to the fact that the resin H has higher dispersibility than that of the resin L.

The toners of Examples 6 and 7 effectively reduced a generated amount of UFPs by using carnauba wax (wax A) and the generated amount of UFPs was more effectively reduced as the amount of wax A decreased. However, the toner of Comparative Example 5 had unacceptably decreased anti-hot offset properties though having a significantly reduced amount of UFPs generation by reducing ΔH values using a very small amount of wax A.

In the toners of Examples 8 and 9, silica as an external additive was used in a fixed amount, i.e., 2 parts by weight and the amount of iron oxide as an external additive was adjusted. In the toner of Comparative Example 7, the amount of iron oxide was small and thus background contamination severely occurred, while background contamination was decreased when iron oxide was externally added. In the toner of Example 9, a reducing effect of background contamination was increased as the ratio of [Si]/[Fe] increased. However, when the ratio of [Si]/[Fe] is 0.005 or greater, background contamination and transfer efficiency increase, but it is expected that toner supply properties may be deteriorated inside a development chamber due to a reduced fluidity, in particular under high-temperature and high-humidity conditions.

From the results shown in Tables 3 and 4, it can be confirmed that the toner to develop electrostatic latent images according to exemplary embodiments of the present inventive concept uses an appropriate combination of a high molecular weight binder resin and a low molecular weight binder resin, an appropriate amount of a releasing agent, and a combination of silica particles and iron oxide particles as external additives, and thus may reduce a generated amount of UFPs and have enhanced fluidity, charging uniformity, charging stability, transfer efficiency, fixability, durability and cleaning ability.

As described above, according to the one or more of the above embodiments of the present inventive concept, a toner to develop electrostatic latent images uses an appropriate combination of a high molecular weight binder resin and a low molecular weight binder resin, an appropriate amount of a releasing agent, and a combination of silica particles and iron oxide particles as external additives, and thus may have the following effects. That is, the toner to develop electrostatic latent images may reduce a generation amount of UFPs and have enhanced fluidity, charging uniformity, charging stability, transfer efficiency, fixability, durability, and cleaning ability.

It should be understood that the exemplary embodiments described therein should be considered in a descriptive sense only and not for purposes of limitation. Descriptions of features or aspects within each embodiment should typically be considered as available for other similar features or aspects in other embodiments.

While the exemplary embodiments of the present inventive concept have been described, it will be understood by those of ordinary skill in the art that various changes in form and details may be made therein without departing from the spirit and scope of the present invention as defined by the following claims.

What is claimed is:

1. A toner to develop electrostatic latent images, the toner comprising a plurality of toner particles, wherein the toner particles comprise:

core particles including a binder resin, a colorant, and a releasing agent; and an external additive attached to outer surfaces of the core particles and including silica particles and iron oxide particles, wherein the releasing agent is carnauba-based wax, wherein an amount of the releasing agent is about 2 to about 2.5 parts by weight based on 100 parts by weight of the binder resin, wherein the binder resin includes a mixture of a high molecular weight binder resin having a number average molecular weight of about 100,000 to about 500,000 g/mol and a low molecular weight binder resin having a number average molecular weight of about 1,000 to less than about 100,000 g/mol in a weight ratio of 90:10 to 10:90, wherein the toner has an endothermic peak by melting of the releasing agent and a stepwise endothermic curve in a second heating curve which is obtained by conducting a differential scanning calorimetry (DSC) measurement of the toner, and wherein a melting temperature Tm determined as a location of the top of the endothermic peak, a glass transition temperature Tg determined as a central point of a linear portion in the stepwise endothermic curve going through glass transition, and a heat of melting ΔH determined as an area of the endothermic peak satisfy the following conditions:

$71° C. \leq Tm \leq 75° C.$, $0.2 J/g \leq \Delta H \leq 0.4 J/g$, and $58° C. \leq Tg \leq 62° C.$

2. The toner of claim 1, wherein a softening point $T_{1/2}$ of the toner, a temperature $T_{20K}$ at which a viscosity of the toner is 20,000 Pa·S, and a temperature $T_{50K}$ at which the viscosity of the toner is 50,000 Pa·S further satisfy the following conditions:

$132° C. \leq T_{1/2} \leq 136° C.$, $117° C. \leq T_{20K} \leq 121° C.$, and $128° C. \leq T_{50K} \leq 132° C.$

3. The toner of claim 1, wherein an intensity of iron [Fe] and an intensity of silicon [Si] measured by X-ray fluorescence (XRF) spectrometry of the toner further satisfy the following conditions:

$0.0001 \leq [Si]/[Fe] \leq 0.004$.

4. The toner of claim 1, wherein the toner has a dielectric loss factor of 0.032 to 0.042.

5. The toner of claim 1, wherein the high molecular weight binder resin and the low molecular weight binder resin are polyester binder resins.

6. The toner of claim 1, wherein the silica particles are fumed silica, sol-gel silica or a mixture thereof.

7. The toner of claim 1, wherein a volume average primary particle size of the silica particles is in a range of about 5 nm to about 80 nm.

8. The toner of claim 7, wherein a volume average primary particle size of the silica particles is in a range of about 30 nm to about 80 nm.

9. The toner of claim 8, wherein a volume average primary particle size of the silica particles is in a range of about 60 nm to about 80 nm.

10. The toner of claim 1, wherein a volume average primary particle size of the iron oxide particles is in a range of about 20 nm to about 100 nm.

11. The toner of claim 10, wherein a volume average primary particle size of the iron oxide particles is in a range of about 30 nm to about 90 nm.

12. The toner of claim 11, wherein a volume average primary particle size of the iron oxide particles is in a range of about 40 nm to about 80 nm.

13. The toner of claim 1, wherein the iron oxide particles have a volume average primary particle size of about 20 nm to about 100 nm, and the silica particles have a volume average primary particle size of about 5 nm to about 50 nm.

14. The toner of claim 1, wherein the silica particles are hydrophobically treated.

15. The toner of claim 14, wherein the hydrophobic treatment is with a silicone oil, a silane, a siloxane or a silazane.

16. The toner of claim 1, wherein an amount of the silica particles is in a range of about 0.1 parts by weight to about 3 parts by weight and an amount of the iron oxide is in a range of about 0.1 parts by weight to about 0.5 parts by weight, respectively, based on 100 parts by weight of the core particles.

* * * * *